United States Patent [19]

Lange

[11] Patent Number: 4,842,270

[45] Date of Patent: Jun. 27, 1989

[54] INTERCHANGEABLE TRACK EXERCISING DEVICE

[76] Inventor: Olaf Lange, Ua Noe St., 121 B, Waikoloa, Hi.

[21] Appl. No.: 235,007

[22] Filed: Aug. 22, 1988

[51] Int. Cl.[4] ..... A63B 21/06; A63B 69/00

[52] U.S. Cl. ..... 272/117; 272/71; 273/26 R; 273/26 B; 273/29 A; 273/191 R

[58] Field of Search ..... 272/71, 116, 117, 118, 272/123, 125, 134; 273/26 R, 26 B, 29 A, 166, 191 R, 191 A

[56] References Cited

U.S. PATENT DOCUMENTS

| | | | |
|---|---|---|---|
| 4,149,713 | 4/1979 | McLeod | 272/117 |
| 4,261,573 | 4/1981 | Richards | 273/191 R |
| 4,333,644 | 6/1982 | Lambert, Jr. et al. | 272/118 |
| 4,568,078 | 2/1986 | Weiss | 272/118 X |
| 4,592,545 | 6/1986 | Sagedahl et al. | 272/125 |
| 4,758,000 | 7/1988 | Cox | 273/191 A X |

FOREIGN PATENT DOCUMENTS

| | | | |
|---|---|---|---|
| 1003863 | 3/1983 | U.S.S.R. | 272/71 |

*Primary Examiner*—Richard J. Apley
*Assistant Examiner*—Robert W. Bahr
*Attorney, Agent, or Firm*—Steve W. Ackerman

[57] ABSTRACT

An exercising device which can train the user in a particular sport, while simultaneously strengthening the muscles used in that sport. Weights are connected via a cable and pulley mechanism to a slider which slides along a track having a selected length and curvature depending upon the sport of interest. The track is interchangeable thus allowing the device to be used for any number of different sports. A handle attached to the slider enables the sliding means to be pulled along the track by the user.

24 Claims, 6 Drawing Sheets

10
12
14
16
18
20
22
24
26
30
34
44
46
48
50
52
60
70
72
100
102
104
106
108
109
110
112
114
115
116
118
120
122
124
126
128
130
132
150
160
170
180
190
200
2
2
7
7
3-3

INTERCHANGEABLE TRACK EXERCISING DEVICE

BACKGROUND OF THE INVENTION

1. Field of the Invention

The present invention relates generally to exercising devices and more specifically to an exercising device which can be tailored to train a user in a selected sport.

2. Prior Art

Numerous exercising devices have blanketed the fitness landscape in the recent past. Such devices take the form of simple hand weights held while jogging, traditional weight bars upon which weights of varying heaviness can be placed or from which such weights can be removed, or elaborate weightlifting systems which often fill entire rooms with apparatus. These devices are generally employed to develop muscle tone and strength. Rowing machines, treadmills, and climbing machines have also achieved popularity, offering cardiovascular conditioning not generally found among weight-type devices.

Conventional weight-type exercising devices are shown, for example, in the following prior art patents: Gaul, U.S. Pat. No. 3,306,611; Salyer, U.S. Pat. No. 4,549,733; and Sebelle, U.S. Pat. No. 4,603,855. Gaul discloses an exercising apparatus designed to allow exercising of various areas of the body. By moving the handle 25 from one point on the device to another, and by adjusting the cable 24 length accordingly, an arm exercise can be transformed into a leg exercise and vice versa.

Similarly, Salyer also discloses a weight-type exercising device which provides for repositioning of a handle grip 60 to allow the user to perform various exercises. By adjusting the "pull point" of the device, the user does not have to be repositioned for different exercises.

Sebelle also discloses a weight-type exercising device which can accommodate different postures of the user's body for accomplishing various exercises. Arm means 13 is both vertically and laterally movable, as well as being capable of extension and retraction.

Prior art exercising devices, such as those described above, relegate the nature of a particular exercise to the user's experience. They leave it for the user to decide how best a particular part of the body should be exercised in order to strengthen and condition that part of the body.

Furthermore, prior art devices are not "sport specific": they are not geared toward training the user in the movements utilized by the various sports. Their goal is developing muscles, conditioning and toning those particular parts of the body exercised. None of the prior art devices are designed to enhance the user's tennis stroke, golf swing, or swimming stroke, for example. There is thus a need for a device with such capabilities. That need is satisfied by the present invention.

SUMMARY OF THE INVENTION

The present invention is an exercising device designed to train the user in a specific activity or sport, while strengthening the muscles used in that activity or sport. By using interchangeable tracks of varying lengths and curvatures, the invention guides the arm(s), hand(s) and/or leg(s) of the user in a specific way so as to develop the correct stroke for a given sport, such as tennis, golf, or swimming.

The present invention is an exercising device having a weight frame which, in turn, has a single or a series of fixed weights which ultimately supply the force to the user during exercise, a cable attached to the weights to enable them to be lifted, and a pulley system upon which the cable rides; a slack adjustment means attached inbetween the cable from the weights and another cable, which is attached at its other end to a sliding means; a cable guide attached to the weight frame directing the cables toward the user; sliding means having a handle for gripping by the user; track means upon which the sliding means rides during exercise; and a number of adjustable track support means to which the track means is attached. The sliding means rides upon the track means, either through use of wheels or by means of a friction-reducing material. The handle can take the form of a ball, stick or racquet corresponding to the particular exercise selected by the user.

In the preferred embodiment of the present invention, as described above, a single weight, cable, pulley, and track mechanism is used and is capable of exercising one side of the body at a given time. In an alternate embodiment of the present invention, an additional weight, cable, pulley, and track mechanism is provided side-by-side with the first one in order to allow the simultaneous exercise of both sides of the body, utilizing both arms, hands and/or legs.

It is therefore an object of the present invention to provide an exercising device which trains the user in a specific sport or activity.

It is another object of the present invention to provide an exercising device having interchangeable track means for guiding the arm(s), hand(s) and/or leg(s) of the user in a specific manner characteristic of a particular sport or activity.

It is still yet another object of the present invention to provide an exercising device which can be used in conjunction with standard weights, thus obviating that additional expense.

It is still yet another object of the present invention to provide an exercising device which allows for repetition of the exercise steps as many times as is desired by the user and at a pace set by the user.

It is still yet another object of the present invention to provide an exercising device which enables the user to exercise his or her left and right arms, hands, and/or legs simultaneously.

The novel features which are believed to characteristic of the present invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description and are not intended as a definition of the limits of the invention.

FIGS., 17, 18 and 19 are drawings showing perspective views of various types of track means according to the present invention.

Figure 20:
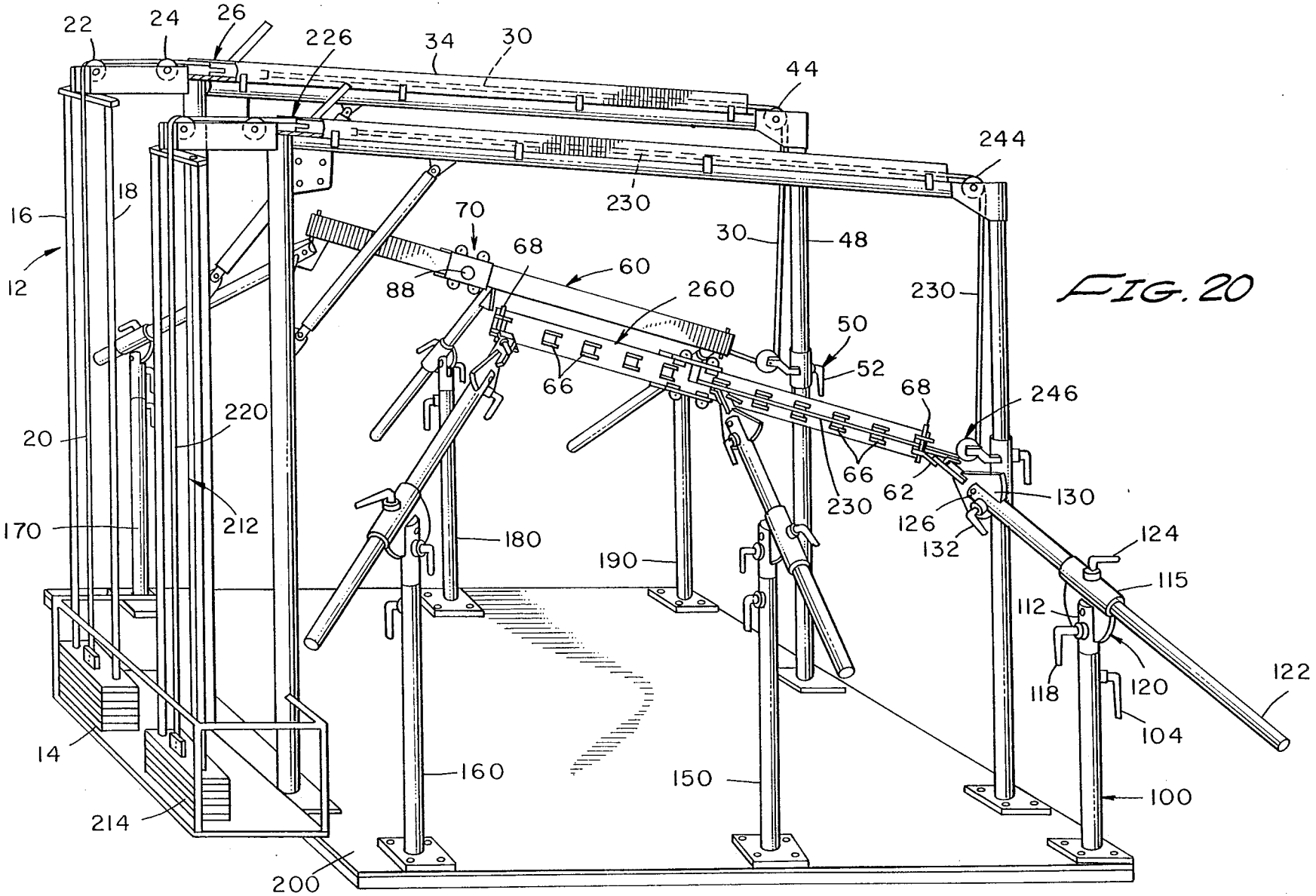

FIG. 20 is a drawing showing a perspective view of the alternate embodiment of the present invention.

DESCRIPTION OF THE PRESENTLY PREFERRED EMBODIMENT

Figures 1, 2:
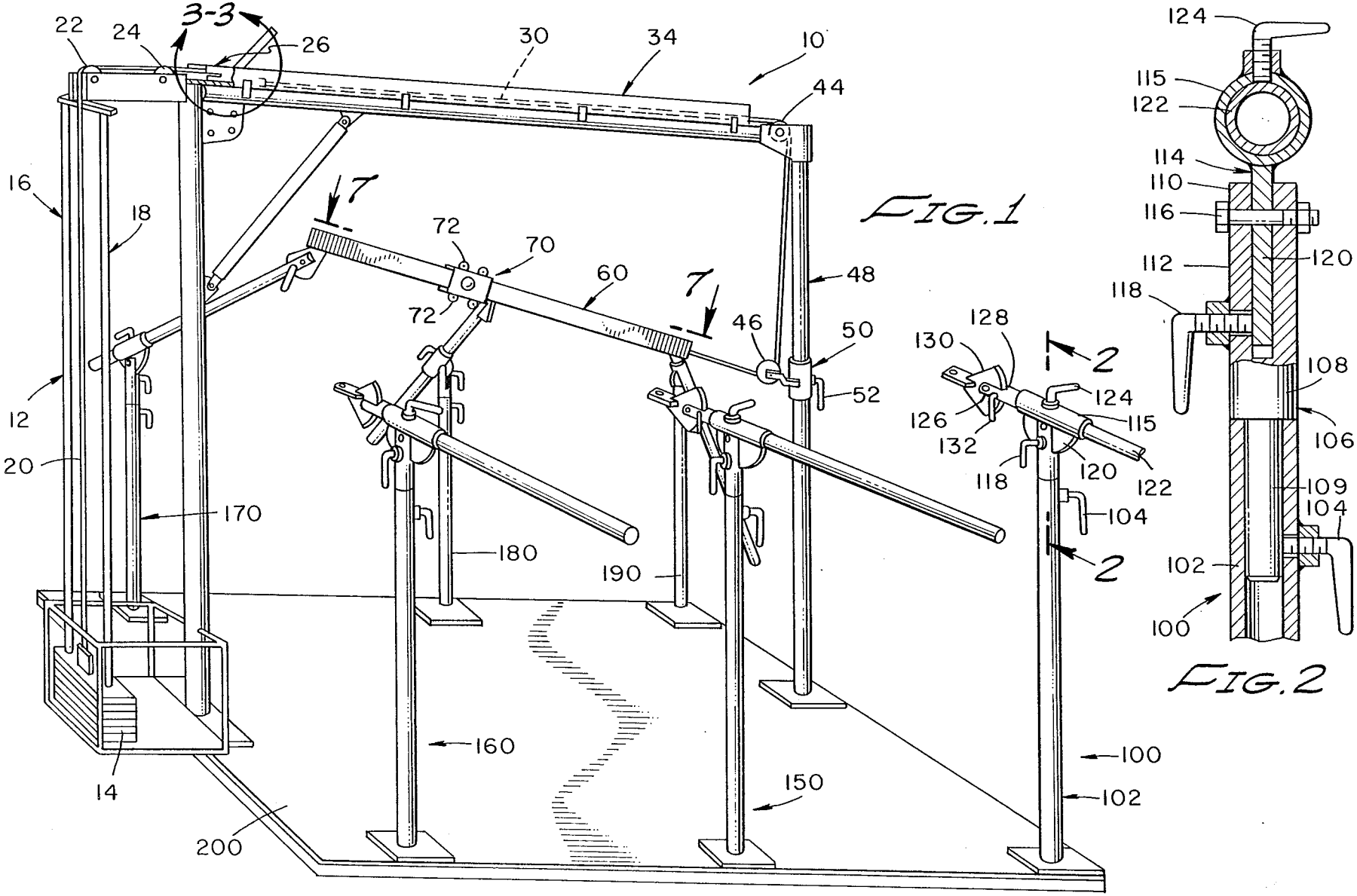
FIG. 1 is a drawing showing a perspective view of the exercising device according to the present invention.
FIG. 2 is a drawing showing a vertical side elevational sectional view of the adjustable track support means taken on lines 2—2 of FIG. 1 according to the present invention.
Figure 3:
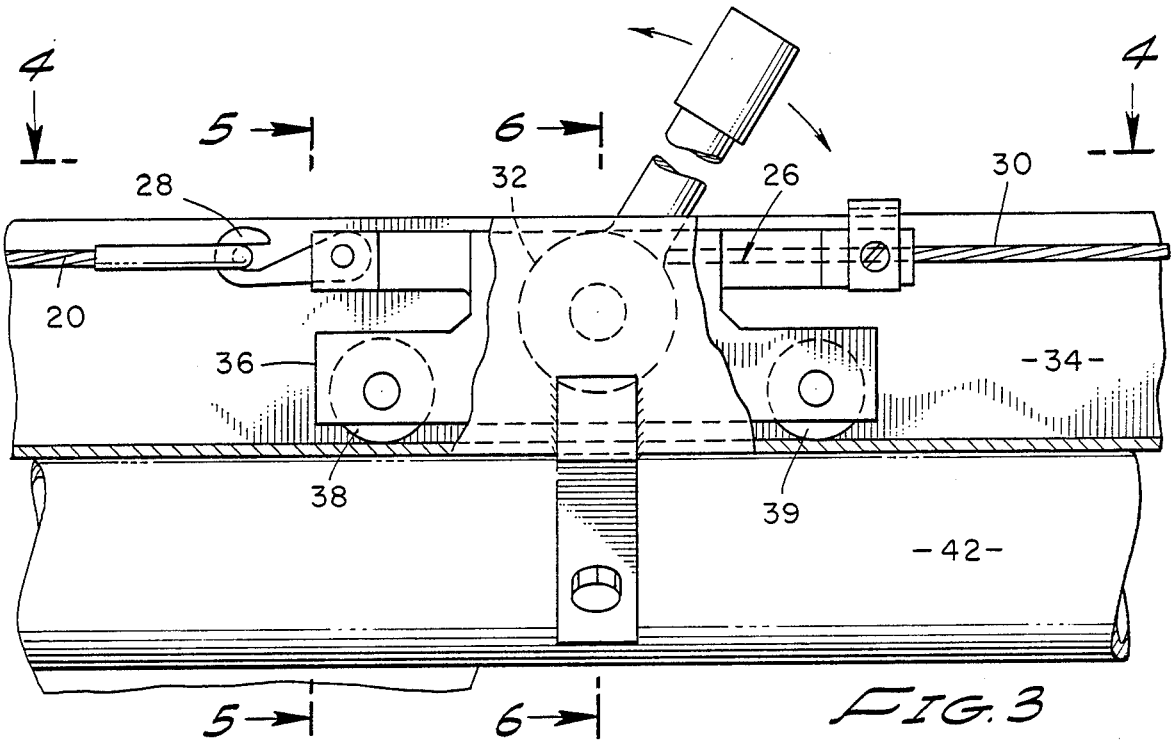
FIG. 3 is a drawing showing a side elevational fragmentary detailed view of the slack adjustment means taken on lines 3—3 of FIG. 1 according to the present invention.
Figure 4:
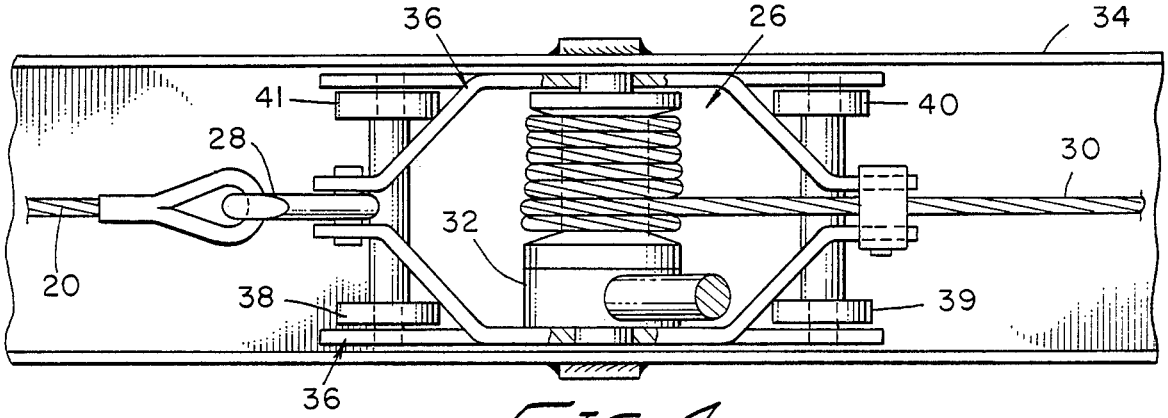
FIG. 4 is a drawing showing a top plan view of the slack adjustment means taken on lines 4—4 of FIG. 3 according to the present invention.
Figure 5:
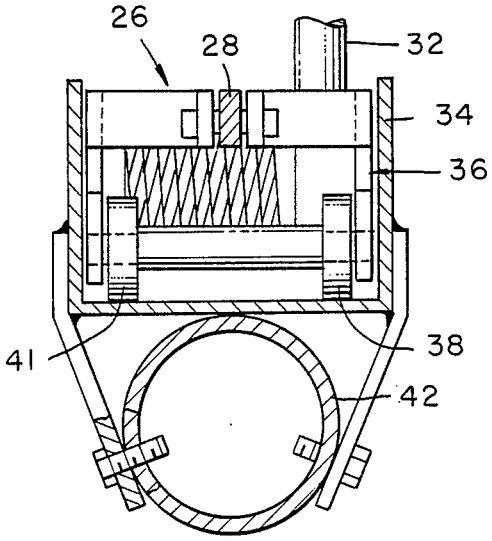
FIG. 5 is a drawing showing a vertical and sectional view of the slack adjustment means taken on lines 5—5 of FIG. 3 according to the present invention.
Figure 6:
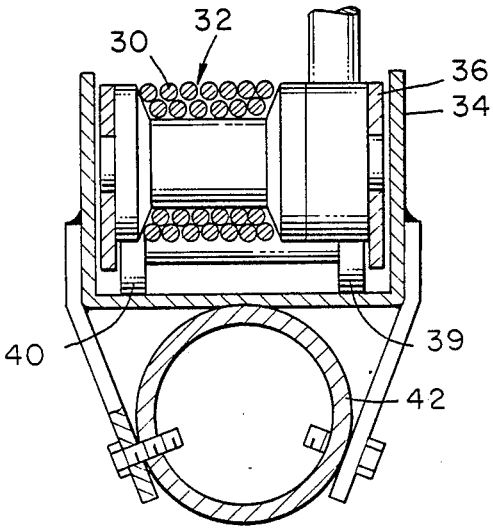
FIG. 6 if a drawing showing a vertical end sectional view of the winch and ratchet mechanism of the slack adjustment means taken on lines 6—6 of FIG. 3 according to the present invention.

Referring more particularly to the drawings, the exercising device of the present invention is generally indicated by the 10 in FIG. 1. A pictorial view of the present invention is shown in FIG. 1.

The present invention has weight frame means 12 which encloses and guides a single or a number of weights 14 during an exercise routine by the user. Weights 14 are moved vertically along guide rails 16, 18 during the exercise routine. Any suitable means can be used to alter the number of weights employed for a given exercise.

Cable 20 is attached at one end to weights 14 to enable them to be lifted and lowered during the exercise routine. Cable 20 can be made of any suitable material having sufficient strength to repeatedly lift and lower weights 14.

Pulleys 22, 24 receive cable 20, which cable 20 rides within the grooves of the pulleys 22, 24. Pulleys 22, 24 direct cable 20 toward a slack adjustment means 26, which slack adjustment means 26 allows the cable to be lengthened or shortened in accordance with the particular track means 60 selected by the user.

Turning now to FIGS. 3-6, cable 20 attached at one end to weights 14 is attached at its other end to hook 28 of slack adjustment means 26. Once cable 30 is attached to sliding means 70 at one end, its other end is attached to the winch and ratchet mechanism 32 of slack adjustment means 26. By using the lever to turn the winch, excess cable 30 is wound around the winch and is secured by the ratchet in slack adjustment means 26. This allows the slack in cable 30 to be taken up by slack adjustment means 26, ultimately allowing for track means 60 of varying length to be used in the exercising device of the present invention.

Cable channel 34 is preferably a three-sided channel. The winch and ratchet mechanism 32 of slack adjustment means 26 is attached to and supported by a frame 36 having wheels 38, 39, 40, 41 which fit within and ride along cable channel 34, providing increased stability as the exercise is performed. Cable channel 34 is preferably attached to bar 42 for added stability.

Turning again to FIG. 1, cable channel 34 directs cable 30 toward pulley 44. Cable 30 is next guided along post 48 toward pulley 46. Pulley 46 is attached to adjusting means 50, which adjusting means 50 allows the end of cable 30 to be raised or lowered. This allows the end of cable 30 to be positioned at the proper point for connection to the particular track means 60 selected by the user.

Adjusting means 50 is secured into position by lockdown means 52, which lockdown means 52 is screwed clockwise into adjusting means 50. It ultimately presses against post 48, thus preventing movement of adjusting means 50. Turning lockdown means 52 counterclockwise releases adjusting means 50 for repositioning along post 48.

Adjustable track support means 100, 150, 160, 170, 180, 190 are provided to support and secure track means 60 in a desired position. In the preferred embodiment, as shown in FIG. 1, three adjustable track support means 100, 150, 160 are attached to one side of base 200 and another three adjustable track support means 170, 180, 190 are attached to the other side of base 200. This allows for right or left-handed operation of the present invention.

Each adjustable track support means, 100, 150, 160, 170, 180, 190 is identical to the others. It is therefore only necessary to describe one such adjustable track support means 100 below.

Post 102 is secured at one end to base 200 and terminates in lockdown means 104. Turning now to FIG. 2, there is shown post 102, which is hollow, into which is placed swivel means 106. Swivel means 106 allows for rotation of the adjustable track support means 100 about a vertical axis. Swivel means 106 features an upper portion 108 which is equal in diameter to post 102. Attached to the upper portion 108 is a lower portion 109, which is slightly smaller in diameter than post 102 and is inserted into the open end of post 102. When fully inserted into post 102, the lower portion 109 of swivel means 106 extends slightly farther than lockdown means 104. Once swivel means 106 has been turned to the desired position, lockdown means 104 presses against the lower portion 109 of swivel means 106 to secure it in that position.

Opposing members 110, 112 of the upper portion 108 of swivel means 106 are employed to receive tilting means 114. Tilting means 114 is permanently attached to the upper portion 108 of swivel means 106 at pivot point 116, which connects opposing members 110, 112 via a connecting post inserted through tilting means 114 and about which tilting means 114 can rotate. This allows for rotation of adjustable track support means 100 about a horizontal axis.

Figures 7, 8, 9, 10, 11:
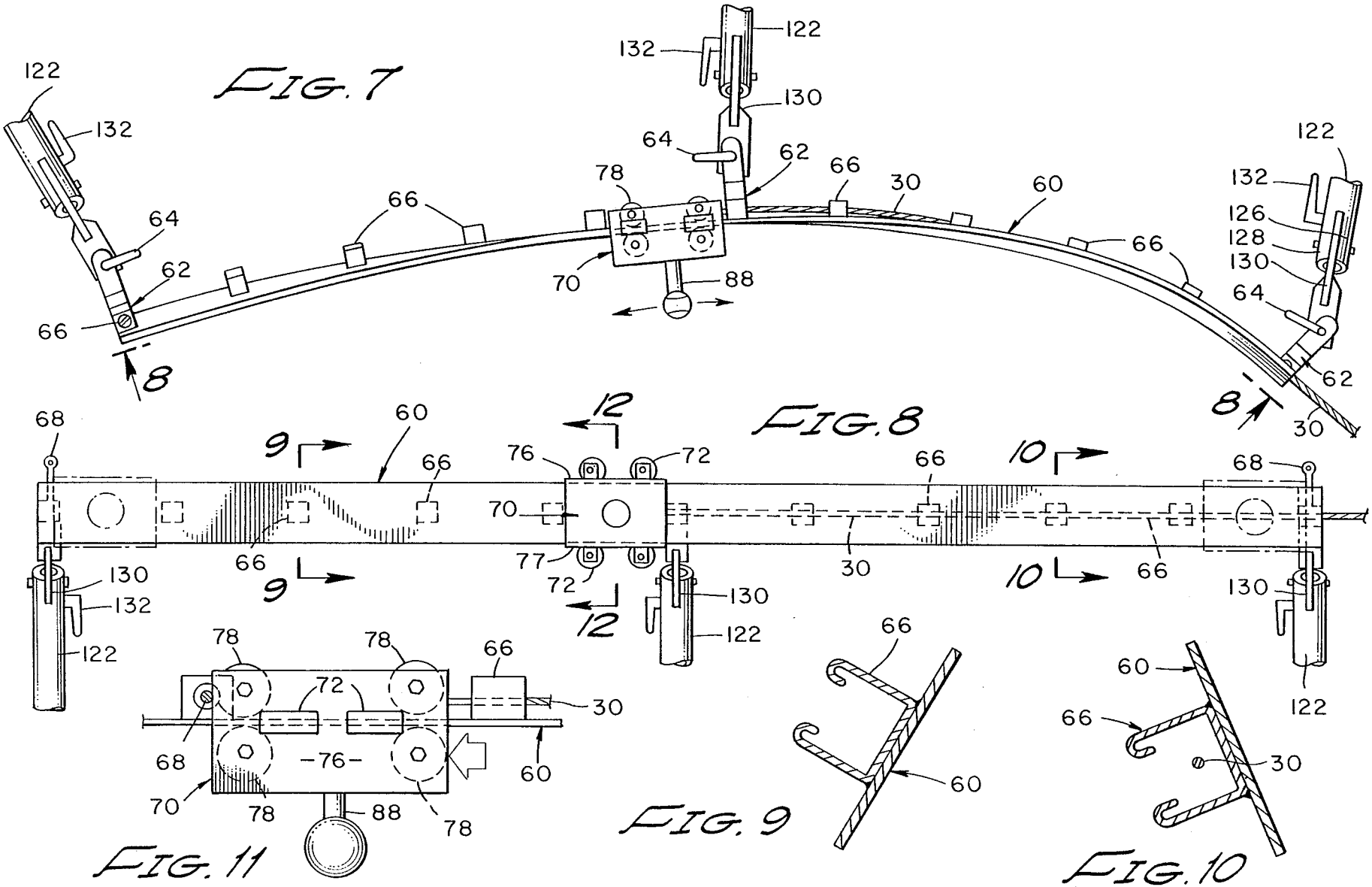
FIG. 7 is a drawing showing a top plan fragmentary elevational view of the track means and sliding means taken on lines 7—7 of FIG. 1 according to the present invention.
FIG. 8 is a drawing showing a front fragmentary elevational view of the track means and sliding means taken on lines 8—8 of FIG. 7 according to the present invention.
FIG. 9 is a drawing showing a sectional view of the track means taken on lines 9—9 of FIG. 8 according to the present invention.
FIG. 10 is a drawing showing a sectional view of the track means, also showing the cable which is attached to the sliding means, taken on lines 10—10 of FIG. 8 according to the present invention.
FIG. 11 is a drawing showing a top plan view of the sliding means in contact with the stop pin at the end of the track means according to the present invention.

Once tilting means is moved to the desired position, it is secured via lockdown means 118. Rotating lockdown means 118 clockwise causes it to press against semi-circular plate 120 of tilting means 114, thus preventing movement of tilting means 114. Turning lockdown means 118 counterclockwise releases tilting means 114 for repositioning. Post 122 is received within the upper portion 115 of tilting means 114 and is secured by lockdown means 124. Post 122 terminates in opposing members 126, 128. As shown in FIGS. 1 and 7, fine adjustment plate 130 is received between opposing members 126, 128. Once fine adjustment plate 130 is moved to the desired position, it is secured by lockdown means 132 which presses against it. Releasing lockdown means 132 allows for repositioning of the fine adjustment plate 130.

Figure 12:
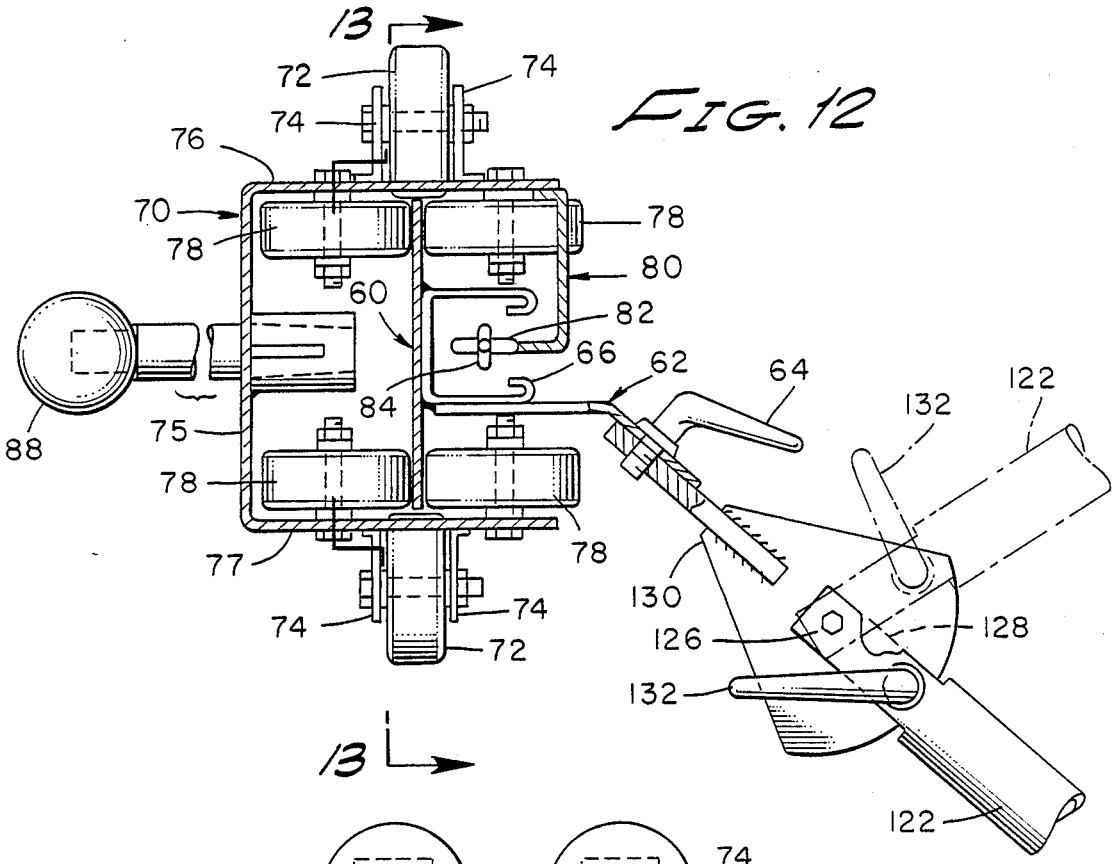
FIG. 12 is a drawing showing a vertical side elevational sectional view of the sliding means and track means, as attached to one of the adjustable track support means, taken on lines 12—12 of FIG. 8 according to the present invention.

As shown in FIGS. 7 and 12, track means 60 is attached to the fine adjustment plate 130 of the adjustable track support means 100. Connection brackets 62 attached to track means 60 are aligned with fine adjustment plate 130. Lockdown means 64 is inserted through the connection bracket 62 and fine adjustment plate 130 to secure them together. Thus, in the preferred embodiment, track means 60 has three such connection brackets 62—one at each end and one at its center.

Turning again to FIG. 7 and also to FIGS. 8, 9, and 10, there is shown in more detail the track means 60 of the present invention. The track means 60 is curved in such a manner so as to guide the hand and arm of a user in an ideal swing or stroke for a particular sport. By repetitive exercise along such ideal path, the user is conditioned into developing a stroke or swing which approximates the curvature of track means 60.

Track means 60 is ideally made of metal or other suitably firm material, but can also be made of a teflon-like substance which would enable the curve of track means 60 to be easily changed yet still provide adequate strength and stability.

Figure 17:
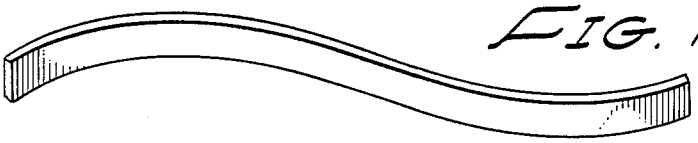
Figure 18:
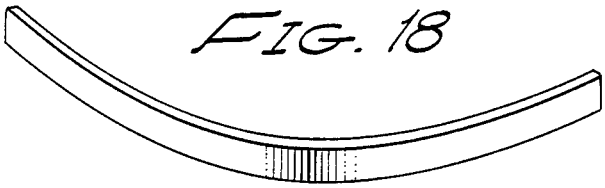
Figure 19:
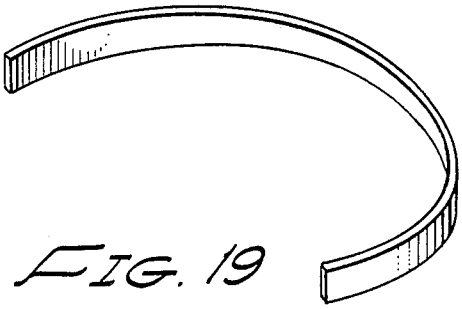

Track means 60 can also be twisted in addition to being curved so as to guide the movements of the hand and wrist during exercise by the user, with the curvature of track means 60 guiding the arm movements of the user. Employing a teflon-like material for the track means 60 is particularly well-suited to altering such hand movements by reconfiguration of the "twist" of track means 60. FIGS. 17 through 19 show various configurations of track means 60, having different curvatures and "twists".

Track means 60 can also be made of any desired length, keeping within the parameters of the adjustable track support means 100, 150, 160, 170, 180, 190. The track means' 60 length can be shortened to focus on development of a portion of a swing or stroke and lengthened to develop the entire swing or stroke.

A plurality of cable guides 66 are attached to one side of track means 60, as shown in more detail in FIGS. 9 and 10. These cable guides 66 minimize the travel of cable 30 as an exercise routine is being performed. This ultimately prevents the cable 30 from becoming entangled with any of the adjustable track support means 100, 150, 160, 170, 180, 190, or from becoming entangled with sliding means 60.

Figure 15:
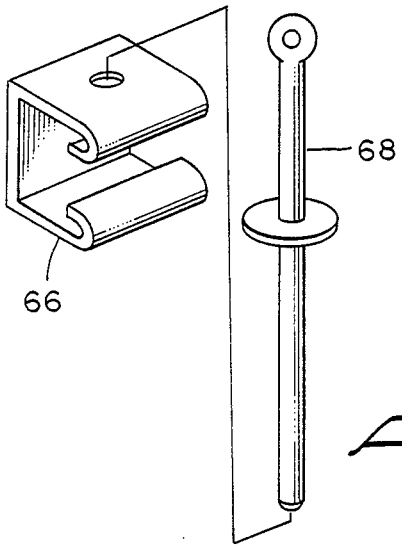
FIG. 15 is a drawing showing an exploded perspective view of a stop pin as it is to be inserted into the track means according to the present invention.

Stop pins 68, as shown in FIG. 15, are inserted into the cable guide 66 at either or both ends of track means 60 to prevent sliding means 70 from traveling beyond the length of the track means 60 at the completion of a swing or stroke, as is shown in FIG. 11. This also allows for repetitive exercise cycles.

Track means 60 can be geared for right or left-handed use. With reference to FIG. 1, if right-handed use is desired, track means 60 should be attached to adjustable track support means 170, 180, 190; if left-handed use is desired, track means 60 should be attached to adjustable track support means 100, 150, 160. For track means 60 with particular "twists" and curvatures, the right and left-handed track means 60 should preferably be mirror images of one another.

Figure 13:
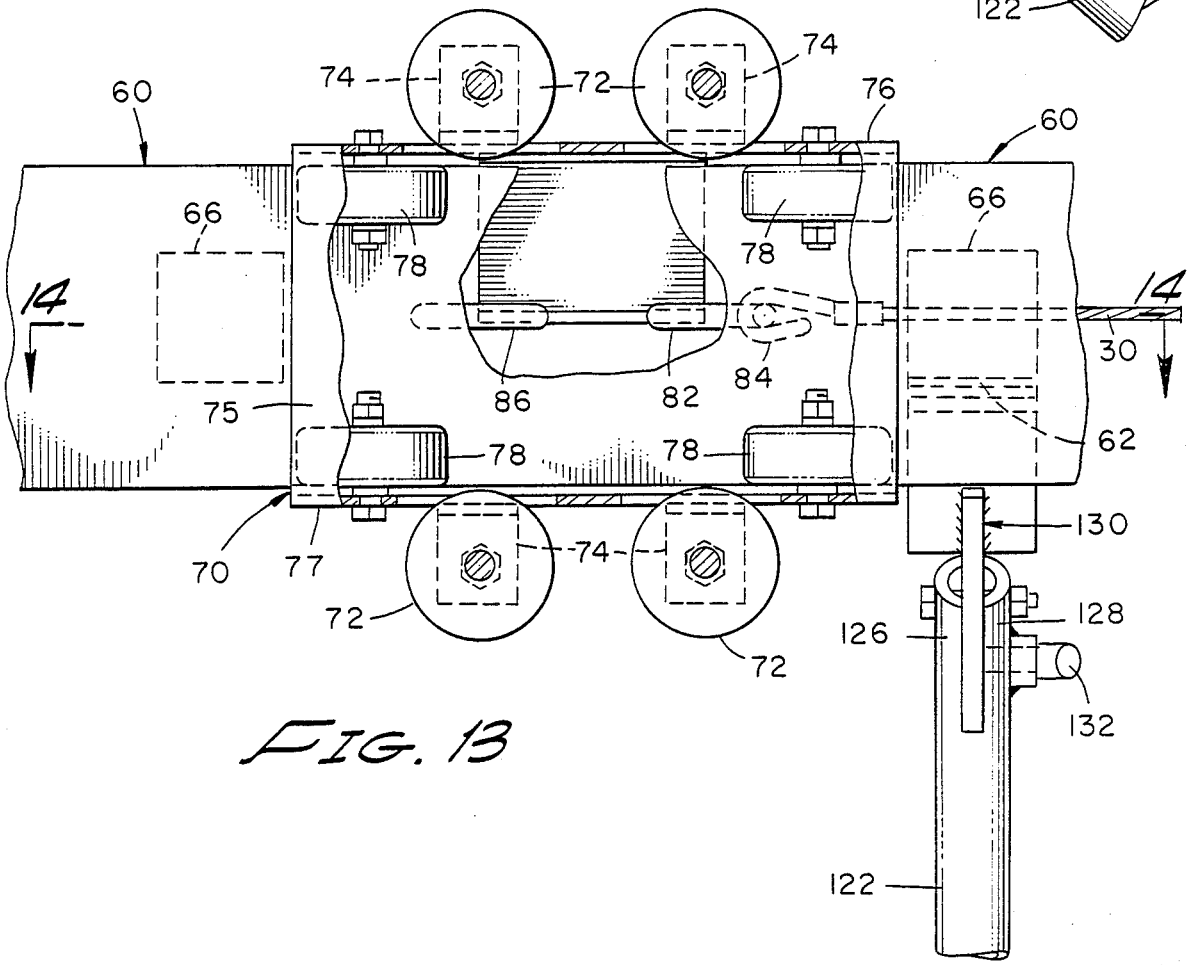
FIG. 13 is a drawing showing a front sectional elevational view of the sliding means, also showing the track means and one of the adjustable track support means, taken on lines 13—13 of FIG. 12 according to the present invention.
Figure 14:
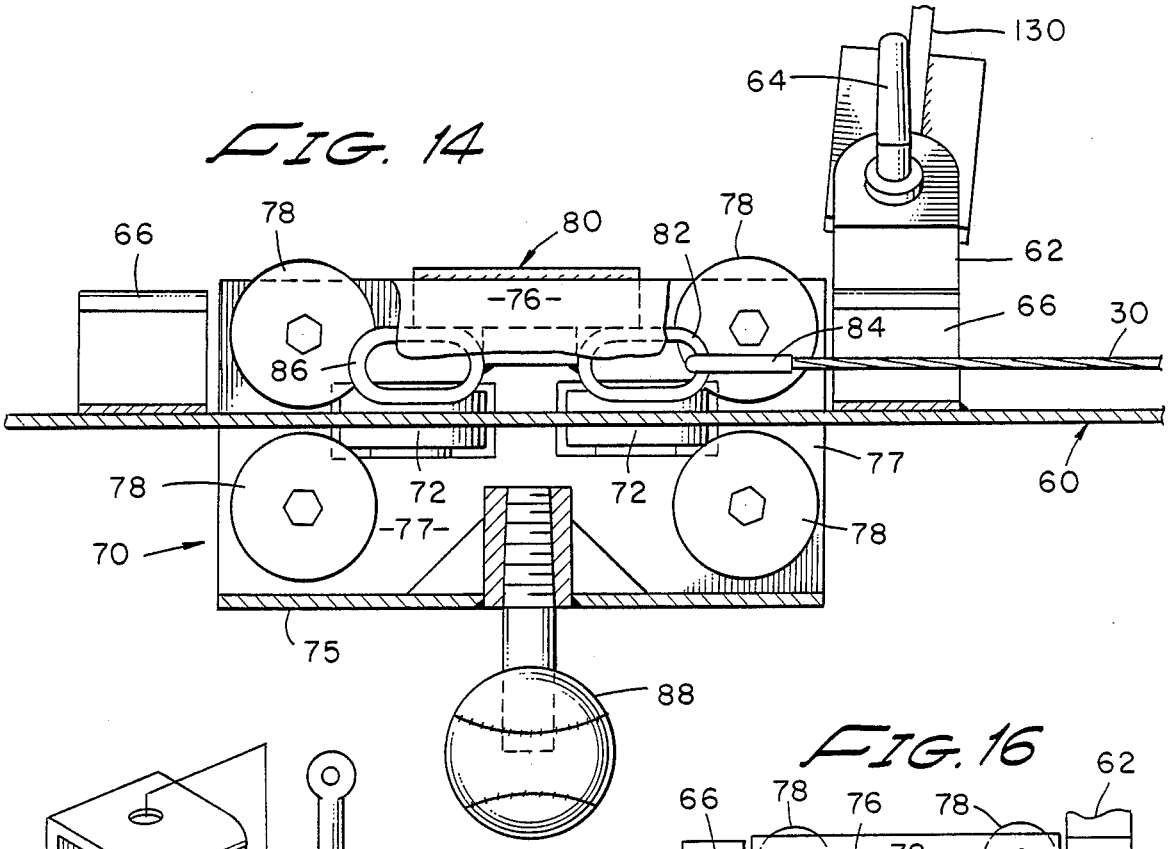
FIG. 14 is a drawing showing a top plan sectional view of the sliding means, also showing the track means and one of the adjustable track support means, taken on lines 14—14 of FIG. 13 according to the present invention.

Turning now to FIGS. 12, 13, and 14, there is shown in detail the sliding means 70 of the present invention. Sliding means 70 is received and travels laterally along track means 60 during exercise by the user.

A plurality of vertical wheels 72 ride along the upper and lower edges of track means 60. Wheel brackets 74 secure vertical wheels 72 in place along the upper 76 and lower 77 portions of sliding means 70. These wheels 72 prevent scraping of the upper 76 and lower 77 portions of sliding means 70 against track means 60, and reduce friction, thus facilitating ease of movement of the sliding means 70 during exercise.

Horizontal wheels 78 are paired along the inner faces of upper 76 and lower 77 portions of sliding means 70. In the preferred embodiment, four such pairs are used. Each wheel 78 of each pair contacts either side of track means 60 and rides along such side during exercise. Such wheels 78 serve to stabilize sliding means 70 and reduce friction between sliding means 70 and track means 60 as sliding means 70 rides along track means 60 during exercise. As an alternative to the use of wheels, the interior surfaces of the sliding means 70 and exterior surfaces of the track means 60 can be coated with any suitable friction-reducing material.

Cable receiving means 80 is attached, in the preferred embodiment, to the upper portion 76 of sliding means 70. Loop 82 accommodates hook 84 which is attached to the end of cable 30. Loop 86 is also provided to allow cable 30 to be attached to either side of sliding means 70.

Figure 16:
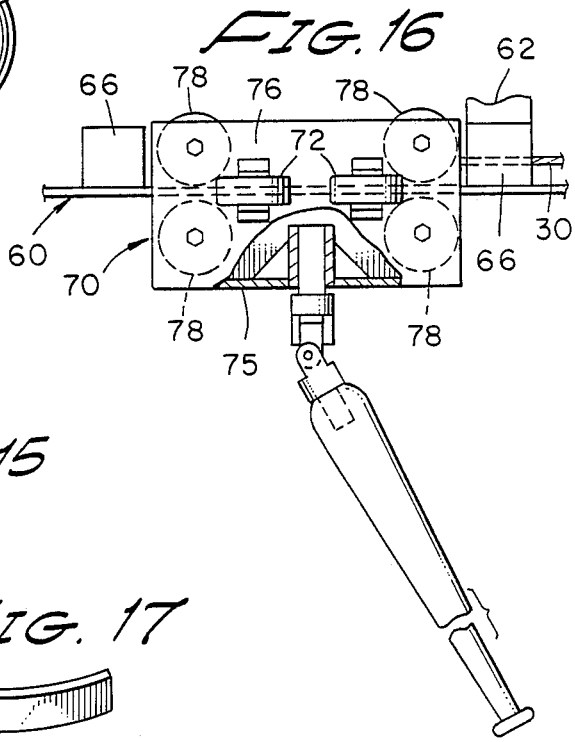
FIG. 16 is a drawing showing a top plan elevational view of the sliding means and the track means according to the present invention with a baseball bat-type handle for the sliding means.

Handle 88 is inserted into side panel 75 of sliding means 70 to allow sliding means 70 to be gripped by the user for movement along track means 60. Handle 88 can assume any suitable shape, and ideally assumes a form corresponding to the sport that the user has sought to improve his or her swing or stroke in through selection of a particular track means 60. For example, handle 88 can assume the shape of a tennis racket handle if track means 60 is curved in such a manner as to approximate a tennis swing. As another example, handle 88 can take the form of a shot put, while track means 60 can be curved to develop the correct form for hurling the shot. As a further example, handle 88 can take the form of a baseball bat, as is shown in FIG. 16.

In the above-described preferred embodiment of the present invention, a single weight, cable, pulley, and track mechanism is utilized. Turning now to FIG. 20, there is shown an alternate embodiment of the present invention which features a dual weight, cable, pulley, and track mechanism, which enables the simultaneous exercise of the left and right arms, hands, and/or legs. This type of exercise is ideally suited to develop swimming strokes, for example.

In this alternative embodiment, two sets of weights 14, 214 are contained within weight frame means 12, 212. Each set of weights 14, 214 is attached to a cable 20, 220. Each cable 20, 220 terminates in a slack adjustment means 26, 226. Another cable 30, 230 is attached to each slack adjustment means 26, 226, is guided by pulleys 44, 46 and 244, 246, respectively, toward separate track means 60, 260 which can be shaped identically, or in mirror images of one another, to accomplish swimming exercises, for example. The user is positioned in between and, ideally, equidistant from, tracks 60, 260. In all other respects, the weight, cable, pulley, and track mechanism in this alternate embodiment is identical to that described above for the preferred embodiment of the present invention. A set of three adjustable track support means 100, 150. 160 and 170, 180, 190 is attached to each one of the tracks 60, 260.

I claim:

1. An exercising device comprising:

weight frame means having variable and moveable weight means for applying force to a user of the exercising device, cable means attached to the weight means, and pulley means attached to the weight frame means for receiving the cable means, the weight frame means guiding the movement of the weight means;

cable channel means attached to the weight frame means for receiving the output end of the cable means from the weight frame means and directing it toward the user further comprising pulley means attached to the cable guide means for receiving and guiding the cable means;

sliding means attached to the output of the cable means from the cable channel means, which sliding means is gripped and pulled by the user during exercise and thus transmits force for lifting the weight means via the cable means;

track means upon which the sliding means is slidably attached for guidance of the user's arm and hand in accordance with a particular exercise; and a plurality of adjustable track support means attached to the track means to hold it stationary in one of a plurality of desired positions.

2. The exercising device of claim 1 wherein the weight means are a plurality of weights.

3. The exercising device of claim 1 wherein the cable means is further comprised of a slack adjustment means for eliminating any slack in the cable means, which slack adjustment means is contained within the cable channel means.

4. The exercising device of claim 1 wherein the sliding means is further comprised of a removably attached handle and cable receiving means to which the output end of the cable means is attached.

5. The exercising device of claim 4 wherein the handle is in the form of a ball, stick or racquet corresponding to the particular track means selected by the user.

6. The exercising device of claim 4 wherein the sliding means has a plurality of wheels mounted parallel to and upon its opposing inner surfaces, and a plurality of wheels mounted perpendicular to and upon its opposing outer surfaces and extending through said surfaces to the interior of the sliding means, said wheels contacting with the track means to reduce friction as the sliding means rides along the track means.

7. The exercising device of claim 4 wherein the interior surfaces of the sliding means and the exterior surfaces of the track means are coated with a friction-reducing material.

8. The exercising device of claim 1 wherein the track means assumes a particular length and curvature in accordance with a stroke associated with a particular sport, which stroke is developed by use of the exercising device.

9. The exercising device of claim 1, wherein the track means has a plurality of cable guides attached to it along its length for accommodating the cable receiving means and preventing excessive travel of the cable means, cable receiving means and sliding means.

10. The exercising device of claim 1 wherein the adjustable track support means are fixed posts mounted perpendicularly to the base of the exercising device terminating in tilting means capable of horizontal and vertical rotation and through which tilting means are slidably inserted posts terminating in fine adjustment plates.

11. The exercising device of claim 10 wherein the fine adjustment plates are connected to a plurality of connection brackets attached to the track means.

12. The exercising device of claim 1 wherein the track means has stop pins at its ends to prevent the sliding means from sliding off the track means.

13. An exercising device comprising:

weight frame means having two sets of variable and moveable weight means for applying force to a user of the exercising device, two sets of cable means attached to the weight means, and two sets of pulley means attached to the weight frame means for receiving the cable means, the weight frame means guiding the movement of the weight means;

two sets of cable channel means attached to the weight frame means for receiving the output end of the cable means from the weight frame means and directing them toward the user further comprising pulley means attached to the cable guide means for receiving and guiding the cable means;

two sets of sliding means attached to the output of the cable means from the cable channel means, which sliding means is gripped and pulled by the user during exercise and thus transmits force for lifting the weight means via the cable means;

two sets of track means upon which the sliding means is slidably attached for guidance of the user's arm and hand in accordance with a particular exercise; and a plurality of adjustable track support means attached to the track means to hold them stationary in one of a plurality of desired positions.

14. The exercising device of claim 13 wherein the weight means are a plurality of weights.

15. The exercising device of claim 13 wherein the cable means is further comprised of a slack adjustment means for eliminating any slack in the cable means, which slack adjustment means is contained within the cable channel means.

16. The exercising device of claim 13 wherein the sliding means is further comprised of a removably attached handle and cable receiving means to which the output end of the cable means is attached.

17. The exercising device of claim 16 wherein the handle is in the form of a ball, stick or racquet corresponding to the particular track means selected by the user.

18. The exercising device of claim 16 wherein the sliding means has a plurality of wheels mounted parallel to and upon its opposing inner surfaces, and a plurality of wheels mounted perpendicular to and upon its opposing outer surfaces and extending through said surfaces to the interior of the sliding means, said wheels contacting with the track means to reduce friction as the sliding means rides along the track means.

19. The exercising device of claim 16 wherein the interior surfaces of the sliding means and the exterior surfaces of the track means are coated with a friction-reducing material.

20. The exercising device of claim 13 wherein the track means assumes a particular length and curvature in accordance with a stroke associated with a particular sport, which stroke is developed by use of the exercising device.

21. The exercising device of claim 13, wherein the track means has a plurality of cable guides attached to it along its length for accommodating the cable receiving means and preventing excessive travel of the cable receiving means and sliding means.

22. The exercising device of claim 13 wherein the adjustable track support means are fixed posts mounted perpendicularly to the base of the exercising device terminating in tilting means capable of horizontal and vertical rotation and through which tilting means are slidably inserted posts terminating in fine adjustment plates.

23. The exercising device of claim 22 wherein the fine adjustment plates are connected to a plurality of connection brackets attached to the track means.

24. The exercising device of claim 13 wherein the track means has stop pins at its ends to prevent the sliding means from sliding off the track means.

* * * * *